US005672142A

United States Patent [19]

Wu

[11] Patent Number: 5,672,142

[45] Date of Patent: Sep. 30, 1997

[54] FOLDABLE EXERCISE DEVICE

[76] Inventor: Tien-Lai Wu, 58, Ma Yuan West Street, Taichung, Taiwan

[21] Appl. No.: 642,801

[22] Filed: May 3, 1996

Related U.S. Application Data

[60] Provisional application No. 60/009,620 Jun. 5, 1996.

[51] Int. Cl.[6] ..... A63B 69/06

[52] U.S. Cl. ..... 482/96; 482/57; 482/72; 482/95

[58] Field of Search ..... 482/96, 95, 57, 482/51, 72, 110

[56] References Cited

U.S. PATENT DOCUMENTS

| | | | |
|---|---|---|---|
| 2,642,288 | 8/1953 | Bell . | |
| 4,300,760 | 11/1981 | Bodroff . | |
| 4,832,336 | 5/1989 | Lahaman | 482/908 |
| 5,299,997 | 4/1994 | Chen . | |
| 5,342,269 | 8/1994 | Huang et al. . | |
| 5,356,357 | 10/1994 | Wang et al. | 482/96 |
| 5,356,358 | 10/1994 | Chen . | |
| 5,366,428 | 11/1994 | Liao . | |
| 5,370,594 | 12/1994 | Grinblat | 482/72 |
| 5,453,066 | 9/1995 | Richter et al. | 482/96 |
| 5,458,553 | 10/1995 | Wu | 482/95 |
| 5,464,378 | 11/1995 | Yu . | |
| 5,478,296 | 12/1995 | Lee . | |
| 5,478,298 | 12/1995 | Chen . | |
| 5,556,361 | 9/1996 | Liao | 482/95 |

FOREIGN PATENT DOCUMENTS

| | | |
|---|---|---|
| 2186498 | 2/1986 | United Kingdom . |
| WO92/18204 | 10/1992 | WIPO . |

*Primary Examiner*—Jerome Donnelly
*Attorney, Agent, or Firm*—Cushman Darby & Cushman IP Group of Pillsbury Madison & Sutro LLP

[57] ABSTRACT

An exercise device is movable between an operating position and a folded, storage position. The device includes rear support structure and front support structure pivotally coupled to the rear support structure so as to be movable between an operative position extending from the rear support structure and a folded position disposed alongside the rear support structure. A seat support structure having a seat thereon coupled to the rear support structure at a pivot location and is constructed and arranged to be moved in opposite directions about its pivot location so that the seat moves arcuately upwardly and downwardly with the seat support structure within a range of operative movements. Lever structure is pivotally coupled to the rear support structure. Foot supports are coupled to an end of the lever structure and a handlebar is coupled to an opposite end of the lever structure. A connecting link is pivotally coupled between the seat support structure and the lever structure such that movement of the handlebar toward the seat pivots the lever structure with respect to the rear support structure causing the seat support structure and seat thereon to move upwardly. The device may be moved into its folded, storage position wherein the front support structure, the lever structure and the seat support structure are disposed generally alongside the rear support structure.

27 Claims, 6 Drawing Sheets

FOLDABLE EXERCISE DEVICE

CROSS REFERENCE TO RELATED APPLICATION

This application claims priority to U.S. provisional application Ser. No. 60/009,620 filed Jan. 5, 1996.

This invention relates to exercise equipment, and more particularly to exercise device which simulates horse-riding.

With the popularity of home exercising increasing, various exercise devices have been developed to provide a low impact aerobic workout. Devices which simulate horse riding tend to take up a great deal of space when in the operating position. Since many homes and/or apartments do not have adequate room to permit an exercise device to be left standing in the operating position, there has been a requirement that the device be foldable to a more compact position for storing.

One such device, for example, disclosed in U.S. Pat. No. 5,464,378, includes a front support structure and an rear support structure extending rearwardly from the front support structure. A seat support is mounted for movement with respect to the rear support and includes a seat on one end thereof and rollers on the other end thereof which engage an inclined track portion of the rear support structure. A pivot lever is pivotally coupled to the front support structure and includes a handlebar at one end and foot rests on the opposite end thereof. A pull-rod is connected to the seat support and to the pivot lever such that when a person seated on the seat moves the handlebar toward and away from the seat, the seat support is moved on the rollers forwardly and rearwardly, respectively, along the inclined track portion. These roller-type devices are effective for their particular purpose but are costly to manufacture, difficult to assemble and do not take full advantage of the user's weight to provide resistance to movement of the seat support.

Thus, there is a continuing need to provide an exercise device which simulates horse-riding having improved motion and which is may be folded easily to storage position.

SUMMARY OF THE INVENTION

An object of the present invention is to fulfill the above need. In accordance with the principles of the present invention, the objective is obtained by providing a foldable exercise device including elongated rear support structure having a rear floor engaging portion. The rear support structure is constructed and arranged to extend upwardly and forwardly of the rear floor engaging portion when the latter is in operating relation with a floor surface. Front support structure is provided and has a front floor engaging portion. The front support structure is pivotally coupled to the rear support structure at a coupling location so as to be disposed in operative relation in a position extending downwardly and forwardly of the coupling location to the front floor engaging portion in operating relation in contact with the floor surface. Each of the rear and front floor engaging portions has an extent sufficient to engage the floor surface at laterally spaced portions when disposed in operating relation to provide stability to the rear and front support structures when disposed in operative relation.

A seat support structure is pivotally coupled to the rear support structure at a pivot location so as to be disposed in operative relation in a position extending rearwardly from the pivot location. The seat support structure has a seat fixedly mounted thereon in a position spaced from the pivot location thereof.

The seat support structure is constructed and arranged to be moved in operative relation in opposite directions about its pivot location so that the seat moves arcuately upwardly and downwardly with the seat support structure within a range of operative movements between a lower limiting position wherein the seat is spaced above the rear support structure therebelow and an upper limiting position spaced above the lower limiting position.

An elongated lever structure is pivotally connected to the rear support structure at a connection location so as to be disposed in operative relation in a position forwardly of the pivot location of the seat support structure. The lever structure, in operative relation, has an upper portion extending upwardly from the connection location and a lower portion extending downwardly from the connection location.

The lever structure includes foot supports coupled to the lower portion thereof, and a handlebar is coupled to the upper portion of the lever structure and disposed forwardly of the seat.

The lever structure is constructed and arranged to be moved in opposite directions about its connection location within a range of operative movements corresponding to the range of operative movements of the seat support structure.

A connecting link structure is pivotally connected between the lever structure and the seat support structure. The connecting link structure is constructed and arranged such that when the lever structure is moved about its connection location by a person seated on the seat by hand and foot movements on the handlebar and foot supports respectively, the seat support structure pivots about its pivot location within the range of operative movements so that the upwardly arcuate movements of the seat away from the lower limiting position are resisted by the weight of the person seated on the seat.

The structures and the interconnection therebetween are constructed and arranged to permit (1) the front and rear support structures to be pivoted relative to one another about the coupling location into a storage position wherein the front support structure is generally alongside the rear support structure and (2) the lower portion of the lever structure and the seat support structure to be moved beyond the range of the operative movements thereof into a storage position disposed generally alongside the rear support structure.

Another object of the present invention is the provision of an exercise device of the type described which is simple in construction, effective in operation and economical to manufacture and maintain.

The invention may best be understood with reference to the accompanying drawings wherein an illustrative embodiment is shown.

DETAILED DESCRIPTION OF THE PRESENTLY PREFERRED EMBODIMENTS

Figure 1:
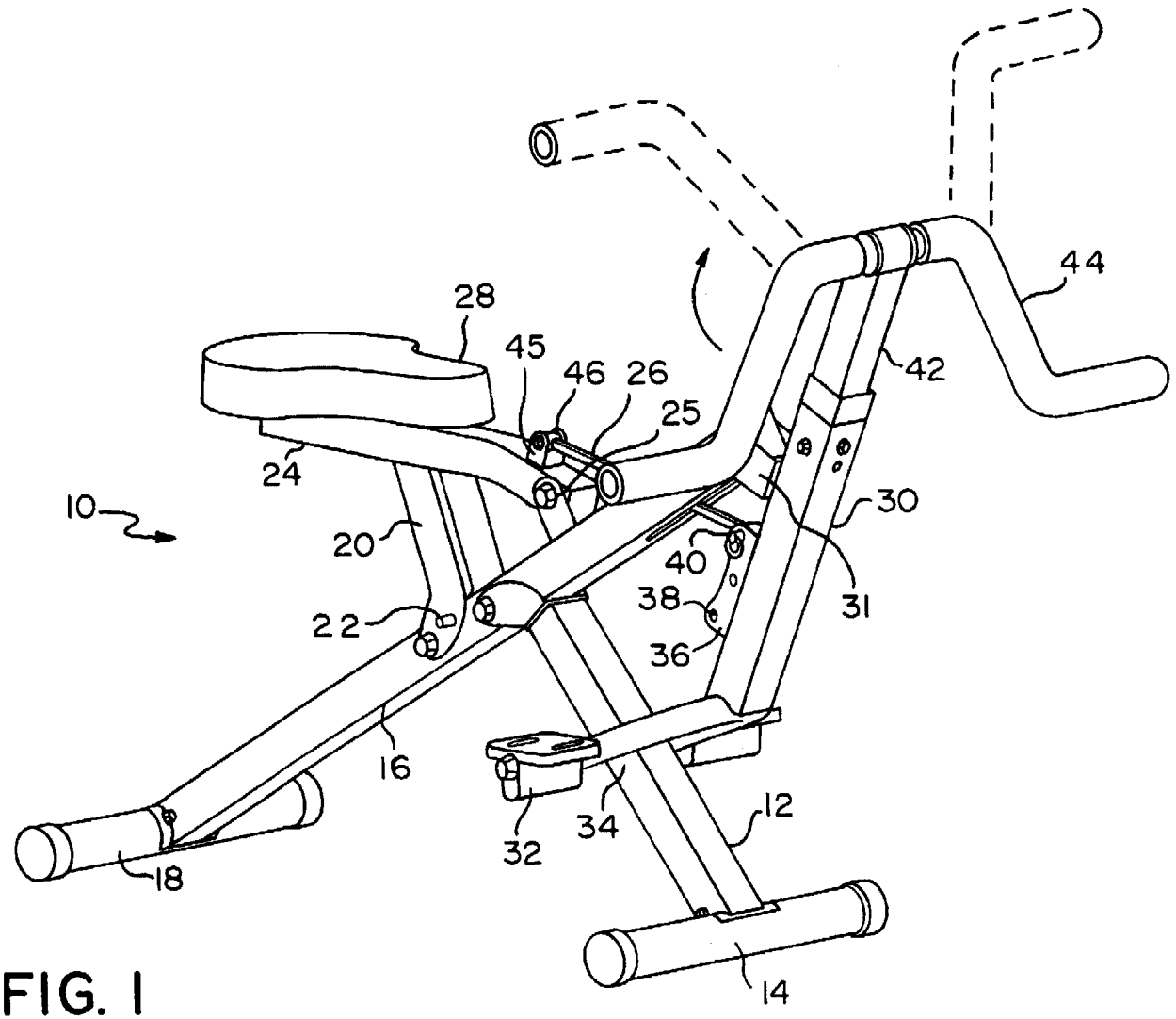
FIG. 1 is a perspective view of a foldable exercise device according to a first embodiment of the present invention viewed from the front of the device.

A foldable exercise device 10 according to a first embodiment of the present invention is shown in FIG. 1. The foldable exercise device 10 includes a rear support structure preferably in the form of a first, or primary, support beam 16, which is preferably straight and which preferably includes a perpendicular rear floor engaging portion or foot member 18 attached at a rearward end thereof with the primary beam 16 attached to the middle of foot member 18. A front support structure preferably in the form of a secondary support beam 12 is pivotally attached, at a first end thereof, to a middle portion of the primary beam 16 and preferably includes, at a second end thereof, a perpendicular front floor engaging portion or foot member 14 attached thereto. The secondary beam 12 is preferably attached to the middle of foot member 14. Secondary beam 12 preferably pivots through a range of positions from a folded position parallel to primary beam 16 to an operative position extending forwardly as shown in FIG. 1. At the forward-most position, further forward pivoting motion is prevented by the top end of secondary beam 12 butting against the underside of primary beam 16.

Figure 7:
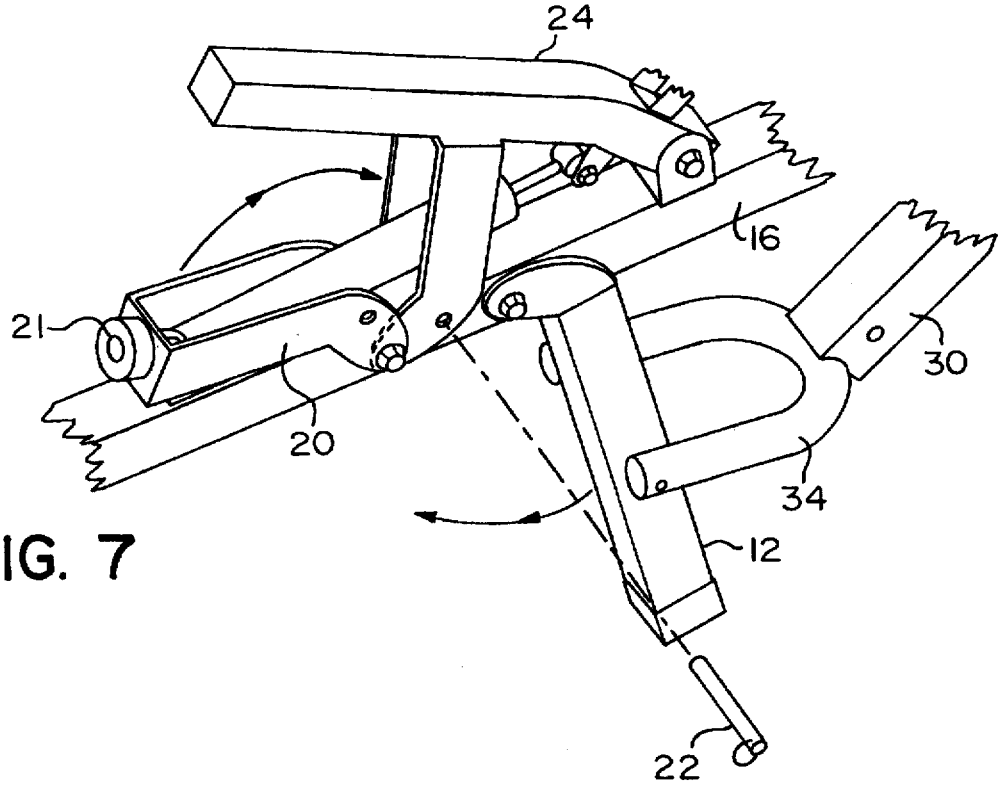
FIG. 7 is a partial perspective view showing details of a pivotable seat stop member.

A seat support structure or member 24 is pivotally attached at an end thereof, as by bracket 25, to a middle portion of the top of primary beam 16. Seat support member 24 includes a seat or seat cushion 28 secured on the upper side thereof. A seat stop member 20 is pivotally coupled to a middle portion of the primary beam 16. Seat stop member 20 is preferably held in operative relation in an upwardly extending first operative position, as shown in FIG. 1, by a pin 22 extending through aligned holes in the seat stop member 20 and the primary beam 16. With seat stop member 20 in its operative position, the seat support member 24, which is pivotable with respect to primary beam 16, is disposed in a lower limiting position or first operating position, prevented from pivoting downwardly further than is shown in FIG. 1. As shown in FIG. 7, seat stop 20 preferably includes a plastic cap 21 fixed to the top thereof.

A lever structure or lever 30 includes an upper end which is pivotally coupled, as by bracket 31, to the forward end of primary beam 16 at a connection location and includes, at a lower end thereof, a foot pedal yoke member 34 extending rearwardly from the lower end of the lever 30. Foot pedals 32 are rotatably fixed on each prong of yoke member 34 so as to extend perpendicularly outwardly therefrom. As an alternative to foot pedals 32, in the broadest aspects of the present invention, foot rests or foot support structure could be provided by a foot bar 33 (shown in phantom in FIG. 2) extending laterally across the lower end of lever 30.

Figure 2:
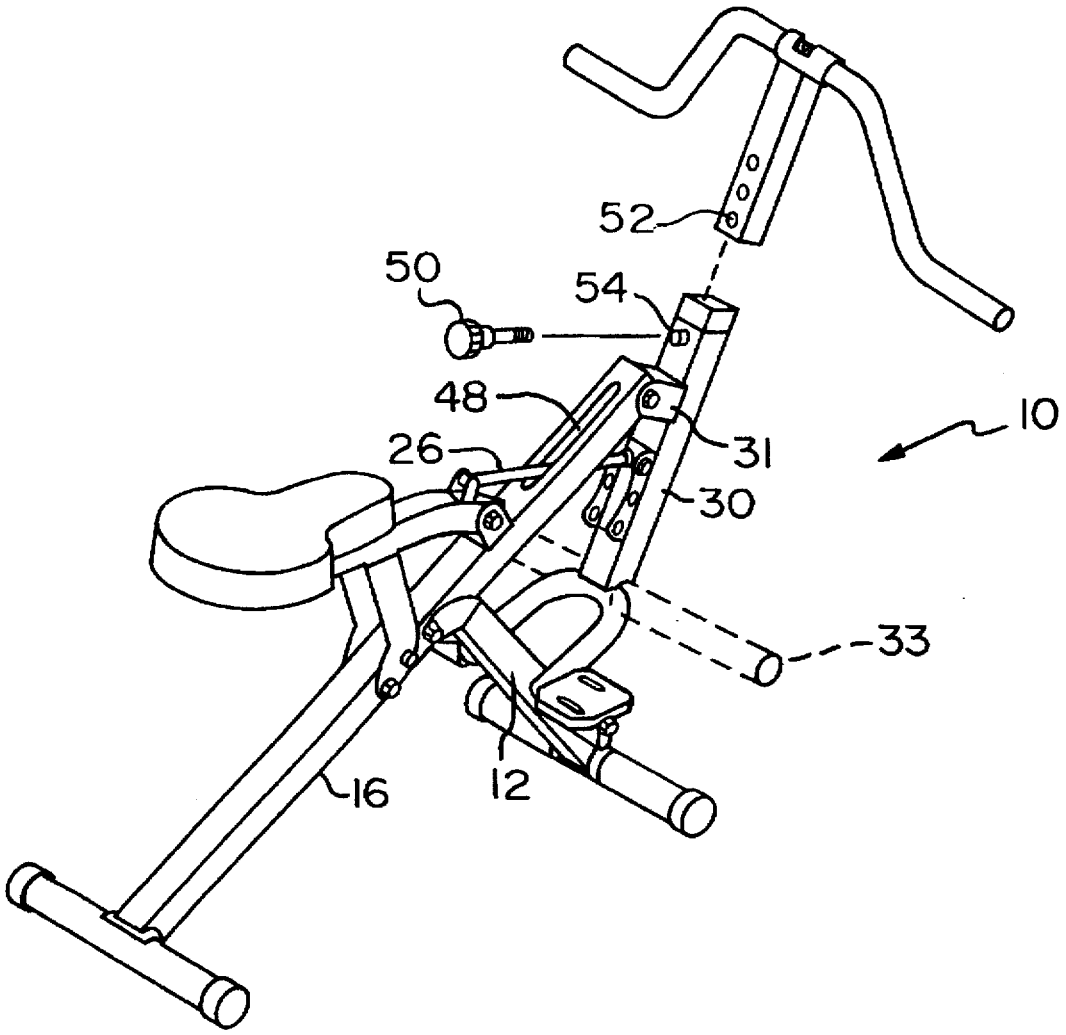
FIG. 2 is a perspective view of a foldable exercise device according to the first embodiment of the present invention viewed from the rear of the device.

An extension 42 is telescopically engaged with the upper end of lever 30. Coupled to the upper end of extension 42 is a handlebar 44. Extension 42 permits vertical adjustment of the handlebar 44. As shown in FIG. 2, extension 42 has formed therein a plurality of holes 52, and lever 30 has formed therein a hole 54. Extension 42 is fixed at a desired vertical position by inserting pin 50 into aligned holes 54 and 52.

Seat support member 24 is coupled to lever 30 by means of a connecting link structure preferably in the form of a link 26, which is pivotally coupled, as by bracket 45, at one end thereof to seat support member 24 and is pivotally coupled at an opposite end thereof, as by bracket 36, to lever 30. Link 26 extends from seat support member 24 to lever 30 through slot 48 in primary beam 16. Link 26 couples motion of seat support member 24 to motion of lever 30. The lever 30 is constructed and arranged to be moved in opposite directions about its connection location within a range of operative movements corresponding to a range of operative movements of the seat support structure. Thus, with the seat support member 25 in its lower limiting or first operating position resting on seat stop member 20, lever 30 is oriented such that the upper end thereof extends forwardly and the lower end thereof extends rearwardly. When lever 30 is pivoted through a range of movements into a second orientation, with the upper end thereof extending rearwardly and the lower end thereof extending forwardly, the seat support member 24 is pivoted through a range of movements corresponding to the range of movements of the lever 30 to a second operating position raised above seat stop member 20.

To use the exercise device of the present invention, the user sits upon seat cushion 28, which is in the lower limiting or first operative position on seat stop member 20, and places his or her feet upon each of the pedals 32, and grasps handlebars 44 at the opposite ends thereof. The user then pushes downwardly on pedals 32 with his or her feet and pulls handlebar 44 toward him/herself, thus causing lever 30 to pivot with respect to primary beam 16. The pivoting of lever 30 causes seat support member 24, coupled to lever 30 by means of link 26, to pivot arcuately upwardly into the second, raised position. Accordingly, the user raises his or her own weight as resistance. Pressure on the foot pedals 32 and the handlebars 34 is then released so that seat support member 24, under the weight of the user, pivots arcuately downwardly to its first position on top of seat stop member 20, and lever 30 returns back to the initial position shown in FIG. 1. By repeating the above forward and backward movements of the lever 30 and corresponding movement of the seat cushion, an aerobic exercise is achieved.

Bracket 36, which couples link 26 with lever 30, preferably includes a plurality of holes 38 through which removable pin 40 maybe inserted into an aligned associated hole in the end of link 26. By pinning the end of link 26 to different positions on bracket 36, the moment arm of link 26 can be adjusted so as to vary the resistance offered by the exercise device in lifting the user's weight.

Although handlebar 44 may be fixed with respect to extension 42, in a presently contemplated embodiment of the exercise device of the present invention, handlebar 44 is preferably pivotable throughout a range of positions which varies from the downwardly extending position shown in solid lines in FIG. 1 through the upwardly extending position shown in phantom in FIG. 1. By being pivotable toward the seat, the handlebar can accommodate the full range of angles between the lever 30 and the user's arms (not shown) throughout the full range of motion of the exercise machine 10. For example, as the user pulls the handlebar toward the seat causing the seat to move upwardly, the handlebar may move in the direction of arrow A (FIG. 1) from a lower limit position to an upper limit position.

Figure 5:
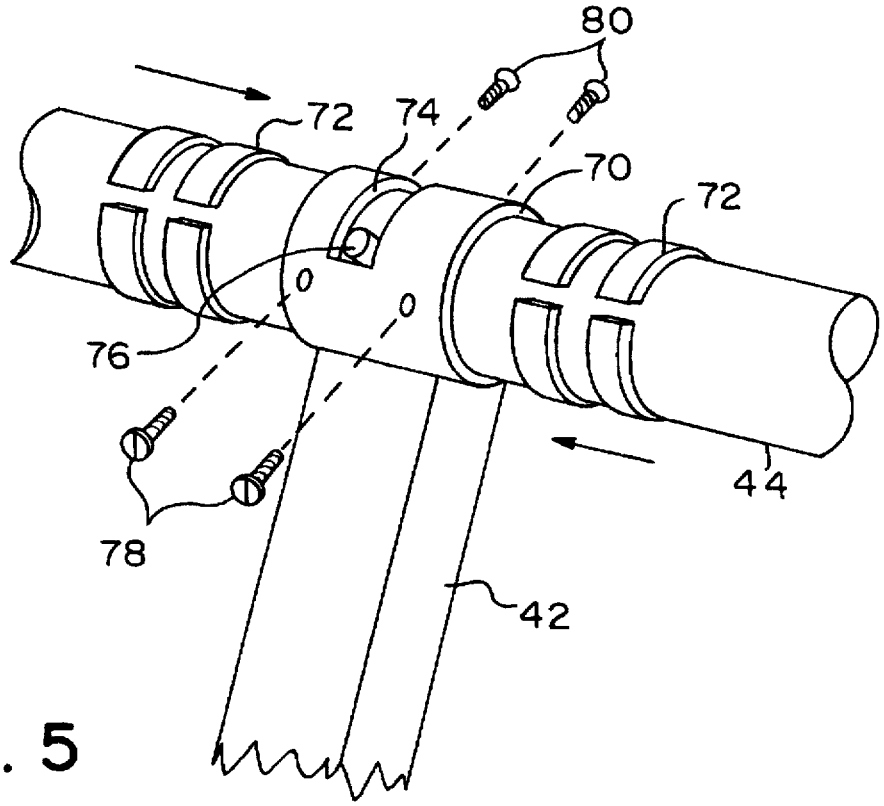
FIG. 5 is a partial perspective view showing a pivotable handlebar assembly.

The pivoting handlebar attachment assembly is shown in detail in FIG. 5. Extension 42 includes a tube portion 70 at the top end thereof. The handlebar 44 is generally U-shaped with a central portion and opposing hand grip portions 47 spaced from the central portion. The central portion is disposed within tube portion 70 and rotatable therewithin. A pin 76 extends outwardly from the center of handlebar 44 and engages with slot 74 which extends approximately 180° around tube portion 70 to limit the range of rotation of handlebar 44 within tube portion 70 between the upper and lower limit positions thereof. Collars 72, preferably composed of plastic, are inserted between handlebar 44 and tube portion 70 to fix the relative spacing therebetween and are preferably held in place by means of screws 78 and 80 extending through holes formed in tube portion 70 into collars 72.

Figure 6:
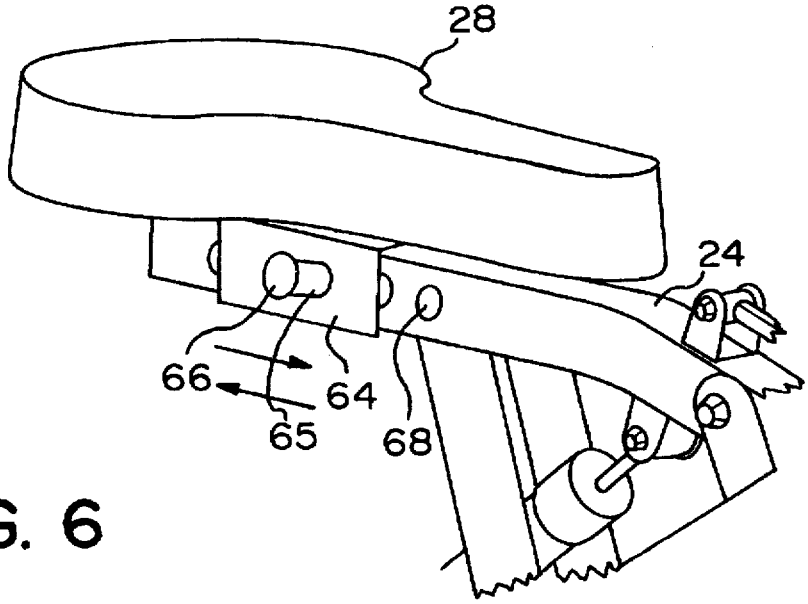
FIG. 6 is a partial perspective view showing an adjustment mechanism of a seat assembly.

Seat 28 is preferably adjustable along a portion of the length of seat support member 24. As shown in FIG. 6, seat support member 24 preferably includes a plurality of holes 68 extending laterally through seat support member 24. Seat cushion 28 is secured onto seat support member 24 by means of sleeve member 64 which slides over seat support member 24. Pin 66 is inserted through hole 65 formed in sleeve member 64 and into an aligned one of the plurality of holes 68 in seat support member 24 to fix the position of seat cushion 28.

Figure 3:
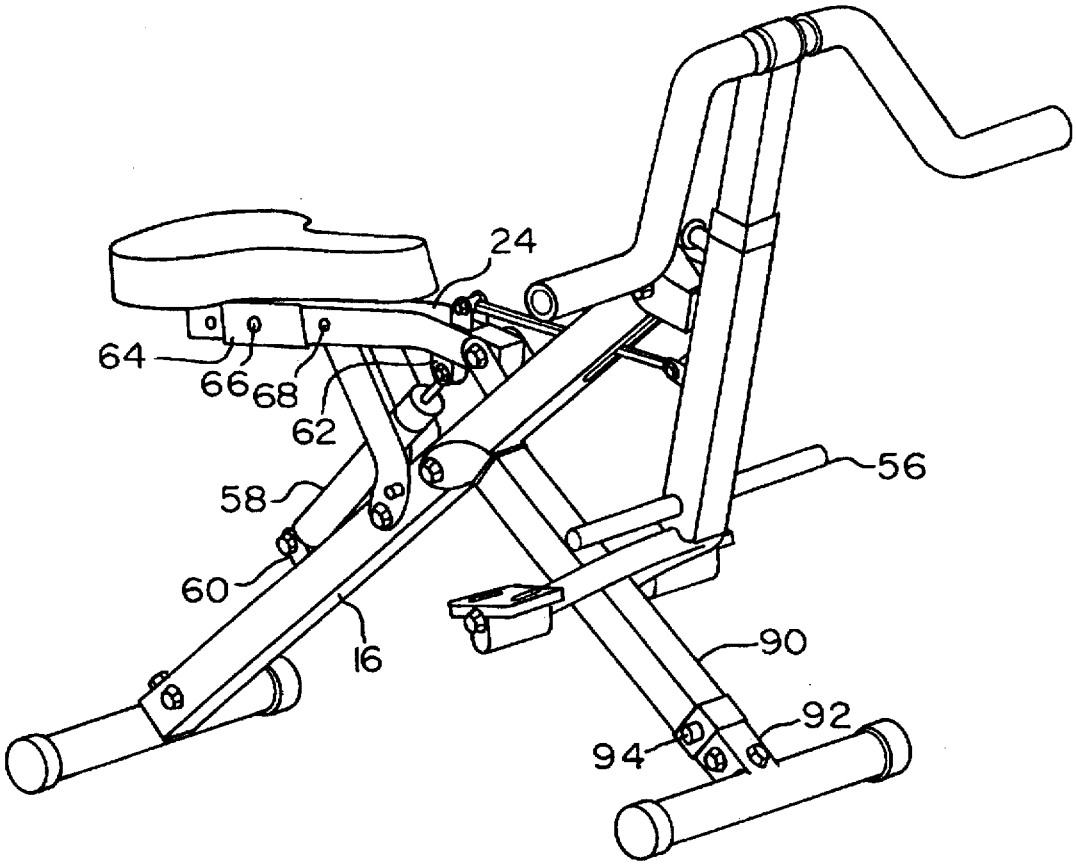
FIG. 3 is a perspective view of a foldable exercise device according to a second embodiment of the present invention.

A second embodiment of the present invention is shown in FIG. 3. FIG. 3 includes an air piston 58 pivotally coupled, as by bracket 60, at one end thereof to primary beam 16, and pivotally coupled, as by bracket 62, at an opposite end thereof to seat support member 24. Air piston 58 provides resistance, in addition to the user's own weight, against the pivoting of seat support member 24, thus enhancing the exercise effect of the machine. Preferably, air piston 58 is adjustable, so that the resistance provided thereby may be varied.

A second modification of the exercise device of the second embodiment of FIG. 3 includes an extendable secondary beam 90 having an extension 92 telescopically coupled with the lower end thereof. Extension 92 may be extended from beam 90 and fixed in a desired position by pin 94 extending through a hole in beam 90 and into an aligned one of a plurality of holes (not shown) formed in extension 92. With the extendable secondary beam, the height of the front end of the exercise device may be increased so as to simulate uphill exercising conditions.

Finally, the exercise device of the second embodiment of FIG. 3 also includes secondary foot rest 56, which provides an alternative position for placing the user's feet.

While the second embodiment of the exercise device of the present invention, as described above and shown in FIG. 3, includes air piston 58, extendable secondary beam 90, and secondary foot rest 56, in the broadest aspect of the presently contemplated invention, alternative embodiments contemplated may include any combination of one or more of these additional features.

Figure 8:
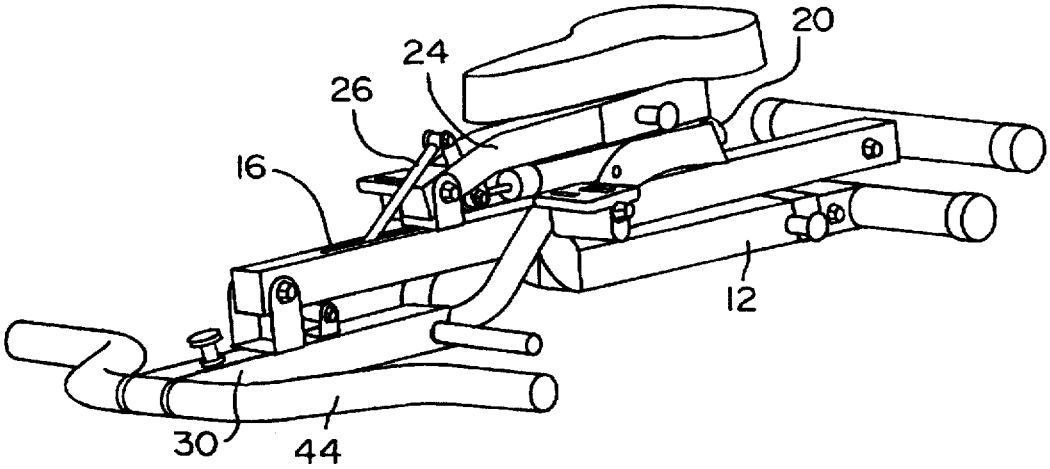
FIG. 8 is a perspective view of a foldable exercise device according to the second embodiment of the present invention, shown in the folded configuration.

Folding of the exercise device of the present invention will now be described in conjunction with FIGS. 7 and 8. To begin folding the exercise device, pin 22 is removed from pivotable seat stop 20. With pin 22 removed, seat stop 20 may be pivoted rearwardly toward primary beam 16 until it is lying down against primary beam 16 in an inoperative, storage position. With seat stop 20 pivoted downwardly, seat support member 24 may too pivot down toward primary beam 16 to an inoperative, storage position. With seat support member 24 pivoted down to primary beam 16, the top of lever 30 extends forwardly such that lever 30 is substantially parallel to primary beam 16. Finally, secondary beam 12 is pivoted rearwardly toward primary beam 16 until it is substantially parallel therewith and disposed in an inoperative position. As shown in FIG. 8, in the folded position, secondary beam 12, lever 30, seat support member 24, and seat stop member 20 are all disposed adjacently to and substantially parallel with primary beam 16 so as to present a relatively narrow and compact profile so that the device may be easily stored or transported.

Figure 4:
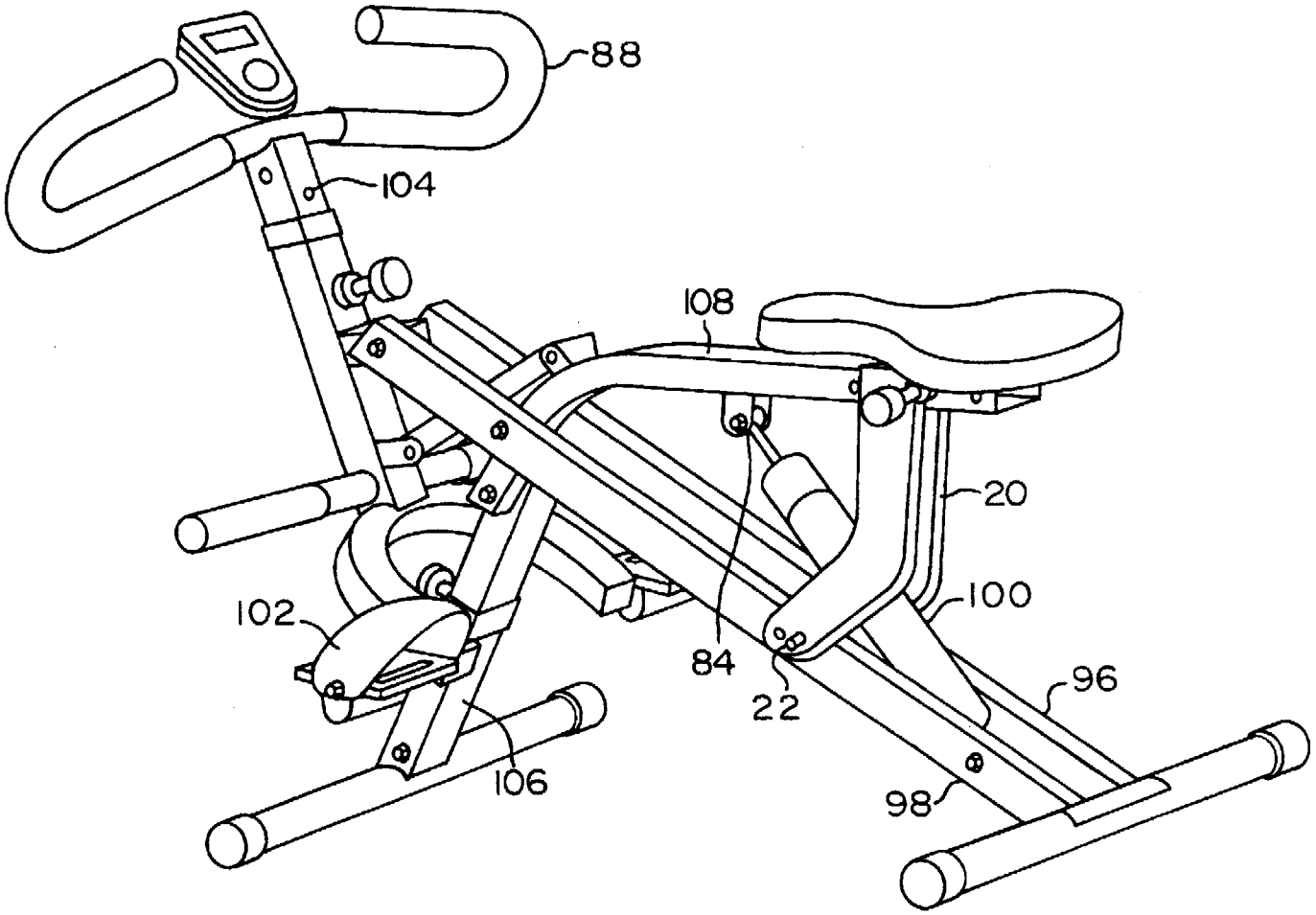
FIG. 4 is a perspective view of a foldable exercise device according to a third embodiment of the present invention.

A third embodiment of the exercise device of the present invention is shown in FIG. 4. In this embodiment, rather than a single primary beam, dual primary beams 96, 98, disposed substantially parallel to each other are provided. This embodiment also includes an air piston 100 disposed between beams 96 and 98. The embodiment of FIG. 4 also includes foot straps 102, which may also be provided on any of the above-described embodiments. Finally, the embodiment shown in FIG. 4 includes a handlebar 88 which is fixed with respect to extension 104.

The embodiment of FIG. 4 is folded much as the embodiments described above. Specifically, pin 22 is removed from seat stop member 20 so that member 20 may be pivoted rearwardly toward beams 96 and 98. With seat stop 20 pivoted out of the way, seat support member 108 may too pivot downwardly toward beam members 96, 98 until it is substantially parallel thereto. Note, however, that due to geometric constraints, pin 84 which pivotally couples air piston 100 to seat support member 108 must be removed to permit complete lowering of seat support member 108. Finally, secondary beam 106 is pivoted rearwardly until it is substantially parallel to beams 96 and 98.

It can be seen that the present invention provides a simple and effective means of enabling an exercise device to be easily moved from an operative position to a folded, storage position.

It thus will be appreciated that the objects of this invention have been fully and effectively accomplished. It will be realized, however, that the foregoing preferred embodiments of the present invention have been shown and described for the purpose of illustrating the structural and functional principles of the present invention and are subject to change without departure from such principles. Therefore, the invention includes all modifications encompassed within the spirit of the following claims.

What is claimed is:

1. An foldable exercise device comprising:

elongated rear support structure having a rear floor engaging portion, said rear support structure being constructed and arranged to extend upwardly and forwardly of said rear floor engaging portion when the latter is disposed in operating relation in contact with a floor surface, front support structure having a front floor engaging portion, said front support structure being pivotally coupled to said rear support structure at a coupling location so as to be disposed in operative relation in a position extending downwardly and forwardly of the coupling location to the front floor engaging portion in operating relation in contact with the floor surface, each of said rear and front floor engaging portions having an extent sufficient to engage the floor surface at laterally spaced portions when disposed in operating relation to provide stability to the rear and front support structures when in operative relation, a seat support structure pivotally coupled to said rear support structure at a pivot location so as to be disposed in operative relation in a position extending rearwardly from the pivot location, said seat support structure having a seat fixedly mounted thereon in a position spaced from the pivot location thereof, said seat support structure being constructed and arranged to be moved in said operative relation in opposite directions about its pivot location so that the seat moves arcuately upwardly and downwardly with the seat support structure within a range of operative movements between a lower limiting position wherein said seat is spaced above said rear support structure therebelow and an upper limiting position spaced above said lower limiting position, an elongated lever structure pivotally connected to said rear support structure at a connection location so as to be disposed in operative relation in a position forwardly of the pivot location of said seat support structure, said lever structure in said operative relation having an upper portion extending upwardly from the connection location and a lower portion extending downwardly from the connection location, said lever structure including foot supports coupled to the lower portion thereof, and a handlebar coupled to said upper portion of said lever structure and disposed forwardly of said seat, said lever structure being constructed and arranged to be moved in opposite directions about its connection location within a range of operative movements corresponding to the range of operative movements of said seat support structure, and a connecting link structure pivotally connected between said lever structure and said seat support structure, said connecting link structure being constructed and arranged such that when said lever structure is moved about its connection location by a person seated on said seat by hand and foot movements on said handlebar and foot supports respectively, said seat support structure pivots about its pivot location within said range of operative movements so that the upwardly arcuate movements of said seat away from said lower limiting position are resisted by the weight of the person seated on said seat, said structures and the interconnection therebetween being constructed and arranged to permit (1) said front and rear support structures to be pivoted relative to one another about said coupling location into a storage position wherein said front support structure is generally alongside said rear support structure and (2) the lower portion of said lever structure and said seat support structure to be moved beyond the range of the operative movements thereof into a storage position disposed generally alongside said rear support structure.

2. The device according to claim 1, wherein said connection link structure couples said lever structure to said seat support structure such that when the person seated on said seat pulls skid handlebar towards said seat and pushes on said foot supports, said seat moves upwardly from the lower limiting position.

3. The device according to claim 1, wherein the interconnection of said seat support structure with said rear support structure includes a seat stop member pivotally coupled to said rear support structure, said seat stop member being constructed and arranged (1) to be disposed in operative relation in an operative position to engage said seat support structure when said seat is in its lower limiting position, and (2) to be moved to a storage position disposed generally alongside said rear support structure.

4. The device according to claim 3, wherein said seat stop member is constructed and arranged to be locked in its operative position.

5. The device according to claim 4, wherein said seat stop member is locked by a removable pin extending through said seat stop member and through a hole defined in said rear support structure, said seat stop member being movable from the operative position thereof to the storage position thereof after removal of said pin.

6. The device according to claim 1, wherein said lower portion of said lever structure includes a yoke member, said foot support structure comprising a pair of pedals mounted on said yoke member.

7. The device according to claim 1, wherein said foot support structure includes a foot rest member extending generally transversely with respect to said lever structure.

8. The device according to claim 1, wherein said lower portion of said lever structure includes a yoke member, said foot supports comprising a pair of pedals mounted on said yoke member and a foot rest member extending generally transversely with respect to said lever structure.

9. The device according to claim 1, further comprising an air piston pivotally coupled between said rear support structure and said seat support structure to provide resistance to the movements of said seat support structure in both directions.

10. The device according to claim 2, wherein said front and rear floor engaging portions comprise front and rear floor engaging foot members, said rear support structure being coupled to generally a mid portion of said rear floor engaging foot member and said front support structure being coupled to generally a mid portion of said front floor engaging foot member.

11. The device according to claim 1, wherein said front floor engaging foot member includes and extension adjustably coupled to said front support structure so as to increase an overall length of said front support structure.

12. The device according to claim 1, wherein said lever structure includes a bracket, said connecting link structure being pivotally coupled to said bracket, said bracket including a plurality of coupling points such that said connecting link structure may be coupled with respect to said lever structure at a selectable one of said coupling points.

13. The device according to claim 12, wherein said bracket includes a hole at each of said coupling points, said connecting link structure including a hole therethrough, said connecting link structure being coupled to said bracket via a pin extending through one of said holes in said bracket and through the hole in the connecting link structure.

14. The device according to claim 1, wherein said handlebar is fixed to said lever structure.

15. The device according to claim 1, wherein said lever structure includes an extension member adjustably connected to said upper portion thereof, said handlebar being coupled to said extension member.

16. The device according to claim 15, wherein said handlebar is fixed to said extension member.

17. The device according to claim 2, wherein said handlebar is generally U-shaped and is mounted for rotation at a central portion thereof with respect to said lever structure for arcuate movement through a range of operative positions including a lower limit position and an upper limit position, said handlebar including opposing hand grip portions spaced from said central portion such that as said handlebar is gripped at said hand grip portions to pivot said lever structure which causes said seat to move upwardly, said handlebar may be moved toward the upper limit position thereof.

18. The device according to claim 17, wherein said lever structure includes an extension member adjustably connected to said upper portion thereof, said extension member including a tube portion having a slot therein, said central portion of said handlebar being disposed within said tube portion so as to be rotatable with respect to said tube portion through said range of operative positions thereof, said handlebar including a pin extending outwardly therefrom so as to engage surfaces of said slot to limit the rotational movement of said handlebar between said upper and lower limit positions.

19. The device according to claim 18, wherein said central portion of said handlebar is coupled to said tube portion via a pair of collars.

20. The device according to claim 1, wherein said front support structure is coupled generally to a mid portion of said rear support structure at the connection location.

21. The device according to claim 1, wherein said rear support structure comprises a single, straight support beam.

22. The device according to claim 21, wherein said support beam includes a slot therein, said connecting link structure extending through said slot.

23. The device according to claim 1, wherein said rear support structure includes first and second beams disposed in parallel relation, said first and second beams being separated by a space, said connecting link structure extending through said space.

24. The device according to claim 1, wherein said seat is constructed and arranged to be adjustably mounted with respect to said seat support structure.

25. The device according to claim 24, wherein said seat support structure includes a plurality of holes extending laterally therethrough, said seat including a sleeve member which is constructed and arranged to slide over said seat support structure, said sleeve member including a hole, said device further including a pin which extends through said hole in said sleeve member and through one of said plurality of holes in said seat support structure to lock said seat to said seat support structure.

26. The device according to claim 1 wherein each of said lever structure, said front support structure, said rear support structure are straight structures.

27. The device according to claim 26, wherein said seat support structure includes a curved portion and a generally straight portion, said seat being mounted to said straight portion.

* * * * *